United States Patent [19]

Sikli

[11] 4,113,065

[45] * Sep. 12, 1978

[54] SCISSORS LIFT

[75] Inventor: Bert J. Sikli, Venice, Calif.

[73] Assignee: Robert Staines, Paramount, Calif.

[ * ] Notice: The portion of the term of this patent subsequent to Oct. 5, 1993, has been disclaimed.

[21] Appl. No.: 781,545

[22] Filed: Mar. 28, 1977

Related U.S. Application Data

[63] Continuation of Ser. No. 594,103, Jul. 8, 1975, abandoned, which is a continuation-in-part of Ser. No. 542,508, Jan. 20, 1975, Pat. No. 3,983,960, which is a continuation-in-part of Ser. No. 406,260, Oct. 15, 1973, abandoned.

[51] Int. Cl.[2] ..... B66B 11/04; E04G 1/22

[52] U.S. Cl. ..... 187/18; 182/141; 254/122

[58] Field of Search ..... 187/8.57, 8.71, 8.72, 187/18, 1 R, 9 R; 52/109; 74/521; 108/145; 182/63, 69, 140, 141, 157, 158; 254/122; 248/421; D12/54, 56, 57; 180/65 F, 66 F, 66 R

[56] References Cited

U.S. PATENT DOCUMENTS

| | | | |
|---|---|---|---|
| 2,617,547 | 11/1952 | Pridy | 187/18 X |
| 2,793,876 | 5/1957 | Allwes | 180/66 R X |
| 2,798,641 | 7/1957 | Coddington | 254/122 X |
| 3,446,379 | 5/1969 | Phillips | 254/122 X |
| 3,858,688 | 1/1975 | Galloway | 187/17 X |
| 3,920,096 | 11/1975 | Fisher | 182/63 |

OTHER PUBLICATIONS

Ballymore Co. Advertisement, Modern Materials Handling, vol. 26, No. 1, Jan. 1971, p. 91.

Ballymore Co. Sales Bulletin S-70R, Ballymore Co., West Chester, Pennsylvania.

*Primary Examiner*—Evon C. Blunk

*Assistant Examiner*—James L. Rowland

*Attorney, Agent, or Firm*—Robert J. Schaap

[57] ABSTRACT

An improved scissors lift is provided which includes a working platform, two scissors linkages, a frame, and a hydraulic mechanism, all of which combine to permit the working platform to be elevated in a horizontal plane to any desired height, and to permit the lift to be collapsed to a compact position when not in use. The hydraulic mechanism, in the form of one or moe hydraulic cyliner/piston units, is mounted on the scissors linkages in an essentially vertical position in appropriate cradles between two of the arm pairs of the linkages, at a position in which there is substantial movement at both ends of the hydraulic unit. The cylinder/piston hydraulic unit is so mounted to exert a thrust primarily in the direction of the load for all positions of the linkages, and to provide an essentially constant load/-thrust/speed ratio for all positions of the linkages, and also to permit full extension of the linkages without excessive movement of the hydraulic piston.

43 Claims, 13 Drawing Figures

SCISSORS LIFT

This application is a continuation of Application Ser. No. 594,103, filed July 8, 1975, entitled "Scissors Lift", (now abandoned) which was a continuation-in-part of co-pending Application Ser. No. 542,508, filed Jan. 20, 1975, entitled Scissors Lift (now U.S. Pat. No. 3,983,960, dated Oct. 5, 1976), and which is, in turn, a continuation-in-part of co-pending application Ser. No. 406,260, filed Oct. 15, 1973 (now abandoned).

BACKGROUND OF THE INVENTION

Scissors lift mechanisms in general are known to the art. The principal purpose of such mechanisms is to provide a safe and efficient means for supporting a working platform at any desired elevation. The scissors lift mechanisms of the prior art are predicated on the well-known "lazy tong" principle, and each comprises a pair of vertically extensible scissors linkages mounted on a frame in laterally spaced, parallel relationship, and a working platform mounted on top of the linkages.

Each of the scissors linkages of the prior art lift mechanisms comprise pairs of arms pivotally connected to one another at their ends and at their centers. The lowermost pairs of arms of the linkages are pivotally mounted at one end to the frame, and they are slidably mounted on the frame at their other end. It is usual in the prior art scissors lift mechanisms to provide an hydraulic drive cylinder mechanism which is pivotally mounted to the frame, and which is coupled to a cross-bar extending between the lowermost pairs of arms of the linkages. The hydraulic lift mechanism serves to turn the arms of the lowermost pair about their pivotal axis to extend or retract the linkages and thereby to raise or lower the platform.

A disadvantage in the prior art hydraulic drive is the fact that as the lift mechanism is initially elevated from its lowermost position, the hydraulic cylinder/piston unit of the prior art hydraulic mechanism is positioned almost horizontal, and it must exert an excessively high trust on the mechanism to turn the lower-most arms and to start the vertical extension of the linkages.

Then, as the prior art lift is extended more and more in a vertical direction, the hydraulic lift unit pivots to an upright position, and it requires less and less thrust to move the load. This results in the need for an excessively large hydraulic lift unit in the prior art scissors lift in order to be effective to move the linkages from their retracted to their fully extended position, and it often leads to the requirement for auxiliary hydraulic lift mechanisms, as described below.

In addition to the above, the lift mechanisms of the prior art are designed so that the arms do not necessarily open uniformly due to the fact that the arms tend to deflect at unsupported locations thereon. In essence, when examining the pivot points connecting a pair of arms in each of a pair of transversely spaced apart scissors linkages, the pivot points in the spaced apart lowermost arms will have a variable difference with respect to the spacing between the pivot points in the uppermost arms during the initial opening. This problem results from the inelastic instability which is inherent in a beam of the type constituting an arm in a scissors linkage.

There have been many attempts to overcome the problems created by the need for excessively large hydraulic lift units, and to overcome the problems created by the inelastic instability in the scissors lift arms with attempts to employ some form of a somewhat vertically disposed hydraulic lift unit. Thus, one such attempt has been described in the U.S. Pat. No. 3,259,369 to Gridley. However, such prior art attempts have usually resulted in excessive structure in the scissors lift unit in order to support the hydraulic unit.

Moreover, in most constructions, these hydraulic units had at least one end thereof directly connected to the pivot point or to a member which was co-parallel in space with a pivot point connecting two corresponding arms of two transversely spaced apart scissors linkages. This structure tended to create some inherent instability and also required a greater amount of opening force when compared to offsetting the hydraulic drive units from the pivot points.

The improved construction of the present invention includes an hydraulic cylinder/lift unit which is mounted in an essentially fixed angular position such that the load vector is essentially aligned with the vertical axis of the unit, so that the trust exerted by the unit is essentially in the direction of the load. Moreover, the hydraulic cylinder/lift unit in the mechanism of the present invention is mounted such that the thrust exerted by this unit remains essentially invariable to move the load through all positions of the linkages. This construction results in minimizing the required capacity of the hydraulic lift unit without in any way detracting from the efficiency and safety of the unit, and thus results in a more economical lift which is capable of movement from a fully compact position to a fully extended position in a simple, economical and efficient manner by means of an hydraulic unit having a fraction of the capacity required in the prior art scissors lift. Saddle mechanisms pivotally secure the upper and lower ends of the hydraulic lift unit in such manner that these units remain in essentially vertical positions.

It is, therefore, the primary object of the present invention to provide a lift in which the hydraulic mechanism is capable of performing a desired function with less thrust and more capacity requirement than any prior art mechanism and on a more economical and safer basis.

It is another object of the present invention to provide a lift of the type stated which provides uniform load transfer to each of the arms in the scissors lift mechanism forming part of the lift.

It is a further object of the present invention to provide a lift of the type stated which overcomes the inelastic instability which otherwise results in beam deflection in prior art types of lift devices.

It is an additional object of the present invention to provide a scissors lift mechanism cooperating with hydraulic power units and which are capable of being used in a wide variety of devices.

With the above and other objects in view, my invention resides in the novel features and form, construction, arrangement and combination of parts presently described and pointed out in the claims.

DETAILED DESCRIPTION OF THE ILLUSTRATED EMBODIMENTS

Figure 1:
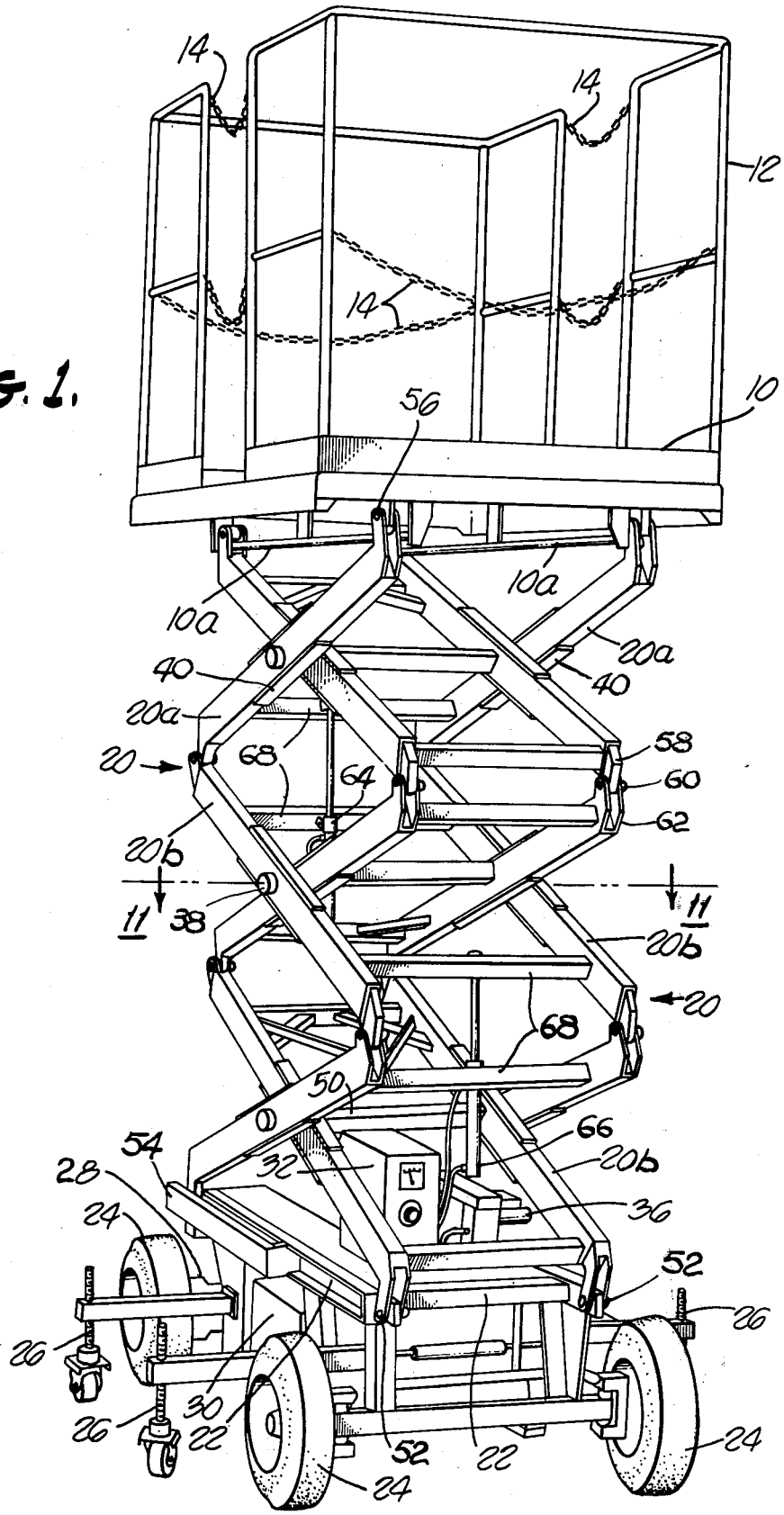
FIG. 1 is a perspective representation of a scissors lift which is driven by two hydraulic cylinder lift units, and which is constructed to embody the concepts and principles of the present invention.

The lift mechanism shown in FIG. 1 includes a usual working platform 10 surrounded by a guard rail 12 equipped with a safety chain 14. The platform 10 is supported at the upper end of a pair of scissors linkages 20. The scissors linkages are mounted on a wheeled frame 22 which is supported on wheels 24, and which is provided with adjustable outriggers 26. Appropriate heavy duty batteries 30 are supported on the frame, as well as a battery charger 32. Also support on the frame are a plurality of usual solenoid valves, and a drive motor 28.

The scissors linkages are made up of a plurality of arms designated as 20*a* and 20*b* which are pivotally coupled to one another at their ends and are pivotally connected at their centers, by means of pins 34, as shown in FIG. 1. Thus, it can be observed that each of the scissors linkages which are located on opposite longitudinal sides of the platform 10 are comprised of tiers of the various scissors arms and each tier of scissors arms comprises one arm designated as 20*a* and one arm designated as 20*b*.

Figure 11:
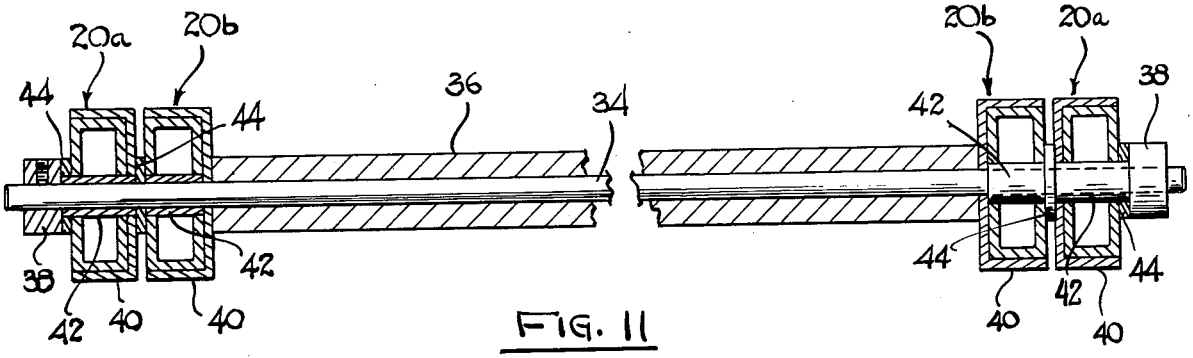
FIG. 11 is a vertical sectional view taken along line 11—11 of FIG. 1.

By reference to FIG. 11, it can be observed that a cross bar 36 extends between each of the pairs of scissors arms 20*a* and 20*b* on each of the transversely spaced apart scissors linkages. It can be observed that in a preferred embodiment of the invention the cross bar 36 is preferably a solid steel member which is internally bored in order to accommodate the pin 34, which may be in the form of an elongate bolt. Moreover, each of the arms 20*a* and 20*b* forming part of the pairs of scissors linkages are retained on the pin or bolt 36 by means of end caps 38, although a bolt head and nut could also be used for this purpose. In this respect, suitable washers and the like could be interposed between the various arms 20 and 20*b* and the end caps 38, as well as the cross bar 36.

It can be observed that inasmuch as each of the arms 20*a* and 20*b* are of a rectangular hollow construction, a doubler, or so-called reinforcing C-shaped bracket 40, is located on one of the vertically disposed surfaces on each of the arms in the manner as illustrated and is provided with upper and lower struck flanges extending over the upper and lower surfaces of the arms. In addition, and by reference to FIG. 11, it can be observed that a cylindrically shaped retaining sleeve 42 is inserted within a horizontally disposed aperture formed within each of the arms 20*a* and 20*b*. Moreover, a bearing 44 is located on the exterior surface of each of the arms and retained by the end caps 38. In this way, it can be observed that it is possible to use a somewhat thin-walled material in the formation of the arms 20*a* and 20*b* and which are reinforced at the load-bearing points by means of the doublers 40 and the cylindrically shaped retaining sleeves 42.

Figure 12:
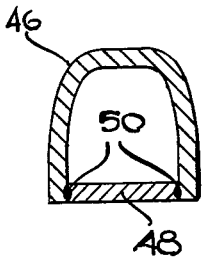
FIG. 12 is a vertical sectional view showing one form of arm construction which may be used in the present invention.

FIG. 12 illustrates one form of arm construction which may constitute any or all of the arms 20*a* and 20*b*. In this case, it can be observed that the arms 20*a* and 20*b* are comprised of a somewhat C-shaped steel section 46 which has been rotated approximately 90° and is provided with a bottom plate 48 welded to the lower ends of the U-shaped steel section 46 by means of welds 50. It has been found in connection with the present invention that this form of arm construction is preferred, due to the fact that it has been found to be highly capable of resisting bending loads. Nevertheless, in the context of the present invention, arms of rectangular cross-sectional shape and similar shapes could be used in the scissors lift of the present invention.

The lowermost pairs of arms 20*a* are pivoted at one end to the frame 22 by means, for example, of bolts 52, and the lowermost pairs of arms are slidable at the other end of the frame in slots, such as the slot 54. The uppermost pairs of arms 20*a* are pivoted at one end to the underside of the platform 10 by bolts, such as the bolts 56, and the uppermost pairs of arms are slidable at the other end of the platform along bars, such as the bars designated 10*a*.

Each of the arms 20*a* of the scissors linkages is provided with a pair of ear-like brackets at each end. By further reference to FIG. 1 of the drawings, it can be observed that the lower ends of each of the arms 20*b*, when in the expanded position, are provided with a single downwardly struck ear-like bracket 58 and the upper ends of each of the arms 20*b* are provided with a pair of spaced apart flanges forming the ear-like brackets 62 at the opposite ends of such arms. The brackets 58 are pivotally connected to the brackets 62 by means of pivot pins 60. In addition, each of the upper ends of the arms 20*a* have the pair of spaced apart flanges forming the ear-like brackets 62 and which are connected to the downwardly struck brackets 58 by means of the pins 60. In like manner, the lower ends of each of the arms 20*a* are provided with a single downwardly struck ear-like bracket, such as the bracket 58.

The ear-like brackets may be welded, or otherwise affixed to the ends of the corresponding arms. The ear-like brackets are shaped to displace the pivotal axis at each end of each pair of arms away from the longitudinal axis of the corresponding arms. This assembly permits each pair of arms to fold down directly on top of the arms of the next lower pair when the lift is in its retracted position, so that a minimum height may be achieved when the lift is collapsed, and also to relieve the stresses at the pivotal points.

The scissors linkages are extended to their uppermost position, such as shown in FIG. 1, and retracted to their lowermost position, by means of hydraulic ram means in the form of one or more hydraulic cylinder units mounted on the linkages in a manner to be explained. In the embodiment of FIG. 1, for example, two such hydraulic cylinder/piston lift mechanisms designated 64 and 66 are used. Each of the hydraulic cylinder units in the embodiment of FIG. 1 are mounted on the linkage between corresponding cross bars 68 extending from one linkage to the other and connected to the adjacent pivoted arms of selected pairs in the linkages. These cross bars are preferably located closer to the outer ends of each of the arms 20*a* and 20*b*.

The hydraulic cylinder units 64 and 66 in the embodiment of FIG. 1 are essentially vertically mounted in a position for substantial movement at each end of each such unit; and each unit exerts thrusts on the corresponding arms of the linkages at points relatively close to their pivotal points, so that maximum extension of the linkages may be achieved without excessive extension of the pistons of the hydraulic unit.

Figure 2:
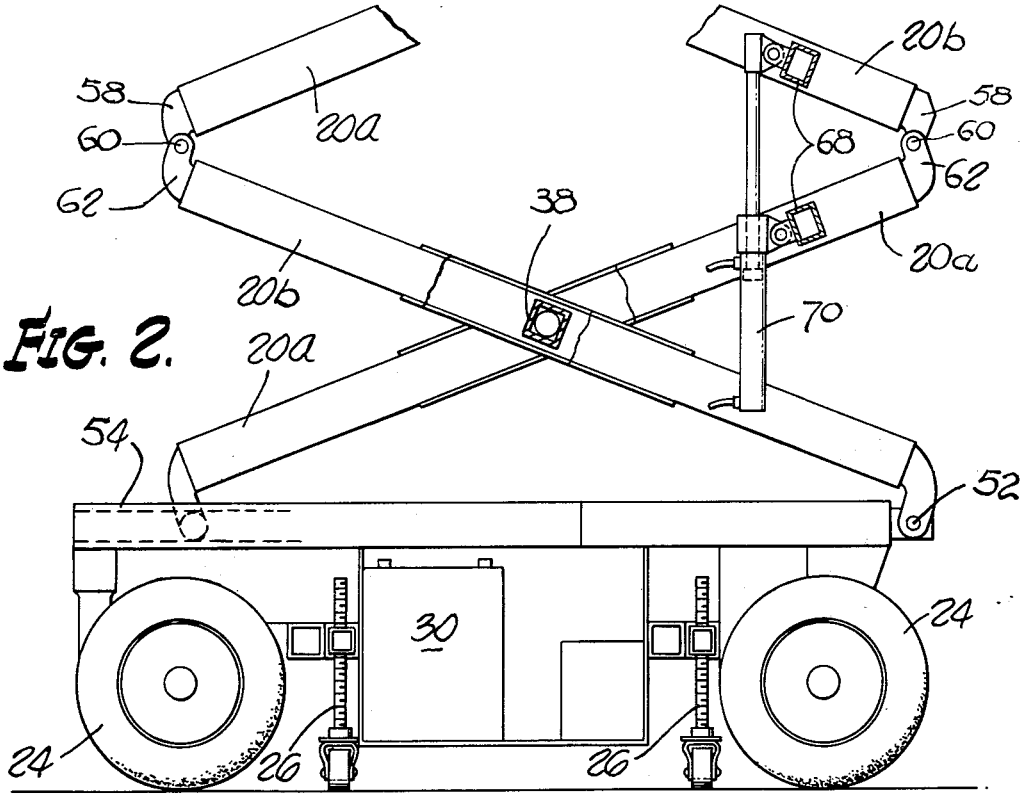
FIG. 2 is a partial side elevation of a lift similar to the lift shown in FIG. 1.

In the embodiment of FIG. 2, a single hydraulic cylinder unit 70 is illustrated, and is coupled to cross bars extending between adjacent arms of the linkages, as in the previous embodiment. In FIG. 2, the hydraulic cylinder unit 70 may extend at an angle slightly to the vertical.

It has been found in connection with the present invention that one of the important criterion with respect to the lift mechanism is that at least one hydraulic lift unit should be used for each of the vertically disposed pairs of tiers of the linkages. Three tiers of linkages are illustrated in FIG. 1, one of the tiers constituting the lowermost tier, the next upper adjacent tier constituting the central tier and the last tier constituting the uppermost tier. However, it should be understood that any reasonable number of tiers could be used.

Thus, in the case of the present invention, it can be observed that one hydraulic lift unit 66 extends between the arms 20*a* and 20*b* in the lowermost tier to the arms 20*a* and 20*b* in the next adjacent upper tier, namely the central tier. In this case, the piston of the hydraulic cylinder unit 66 is connected to the cross bar 68 of the central tier. In like manner, the hydraulic unit 64 extends between this latter mentioned pairs of arms 20*a* and 20*b* in the central tier such that the piston of the hydraulic lift unit 64 extends to the cross bar 68 in the arms of the third or uppermost tier. In the event that additional tiers of linkages were used, additional cylinder units would also be employed in like manner.

Again, and in connection with the present invention, it has been found desirable to locate one hydraulic cylinder unit, such as the unit 66, on one side of the two vertically disposed tiers with respect to the central pivot, as defined by the pivot pin 34, and the next hydraulic unit, such as the unit 64, on the opposite side of the central pivot, as defined by the pivot pin 34. In the event that a fourth linkage tier of arms were employed, a third hydraulic unit (not shown) would be located in substantially vertical alignment with the hydraulic unit 66. Moreover, the cylinder portion of this unit would be connected to one of the cross bars 68 in the third or uppermost tier of arms, as illustrated in FIG. 1, and the piston portion thereof would be connected to a cross bar 68 in the fourth tier of arms.

Figure 3:
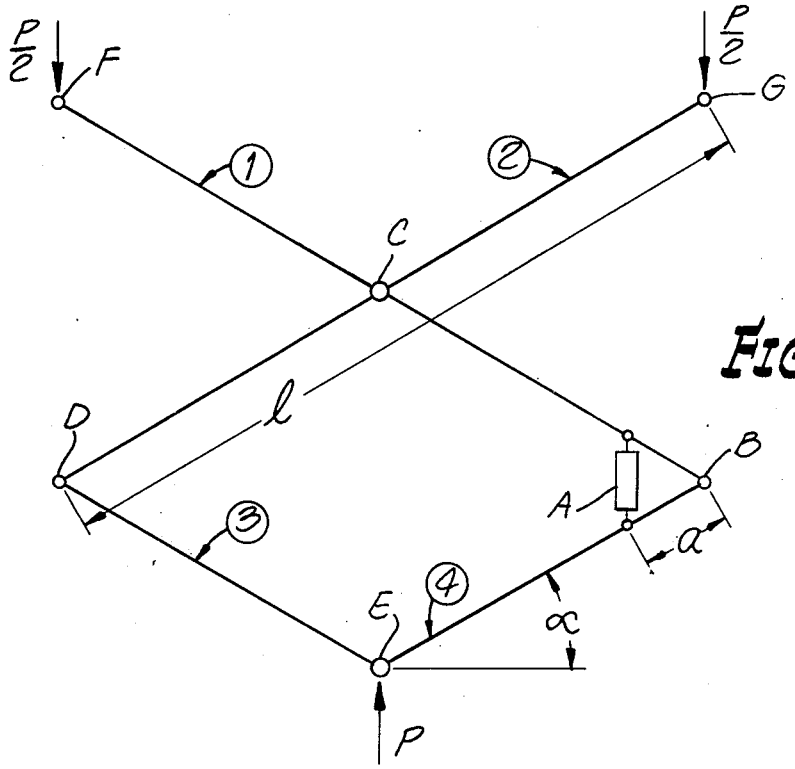
FIG. 3 is a schematic force diagram of the trust exerted on the arms of the scissors lift by each of the hydraulic units in the mechanism of FIG. 2.

In the force diagram of FIG. 3 the arms of one of the linkages are designated 1, 2, 3 and 4, respectively, and the hydraulic cylinder unit A is shown as intercoupled between the arms 1 and 4 adjacent the pivot point B of the two arms. The arms 1 and 2 are pivoted at a point C at the center of the arms, the arms 2 and 3 are pivoted at a point D at the ends of the arms, and the arms 3 and 4 are pivoted at a point E at the ends of the arms.

The upper platform asserts a downward force P/2 at the ends F and G respectively of the arms 1 and 2, whereas the hydraulic cylinder unit effectively exerts a force P at the intercoupled end E of the arms 3 and 4. Each of the arms is assumed to have a length of "1", the hydraulic cylinder unit A is assumed to be displaced from the pivot point B by a distance *a*. The inclination of the arms to the horizontal in the illustrated diagram of FIG. 3 is $\alpha$.

Figure 4:
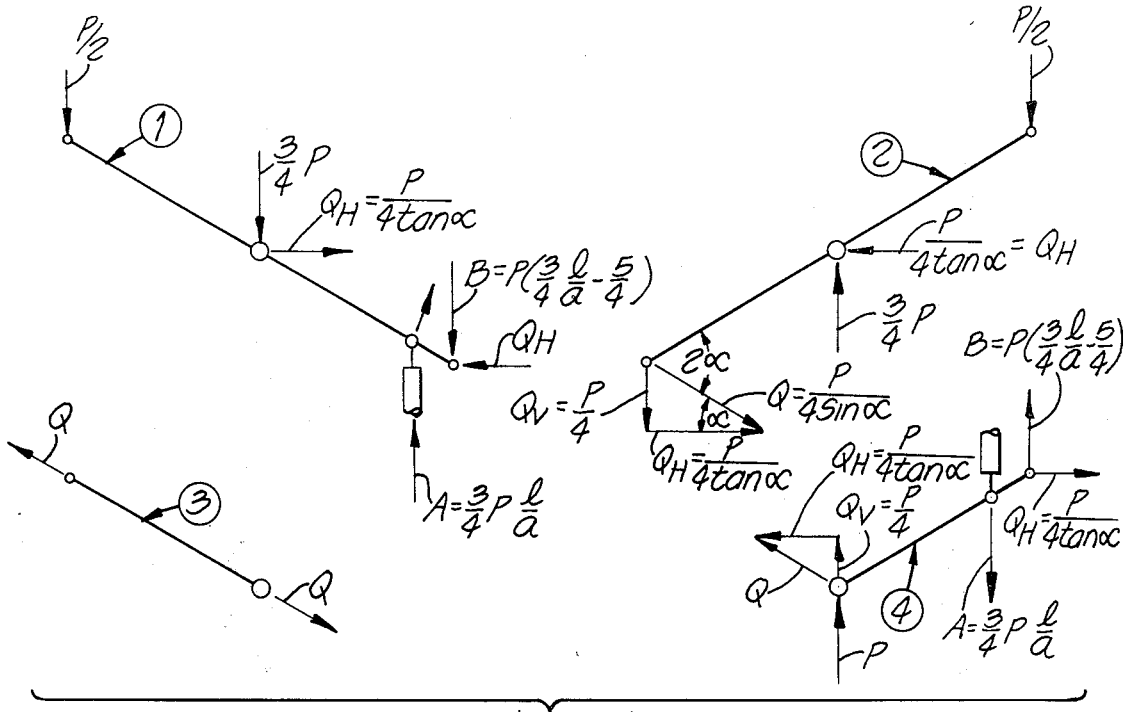
FIG. 4 are vector diagrams of the forces developed in the force diagram of FIG. 3.

The resulting bending moment forces exerted on the arms 1, 2 and 4 are represented in FIG. 4, the arm 3 being purely in tension. The resulting bending moments on the arms are represented by the curves of FIG. 5.

Figure 5:
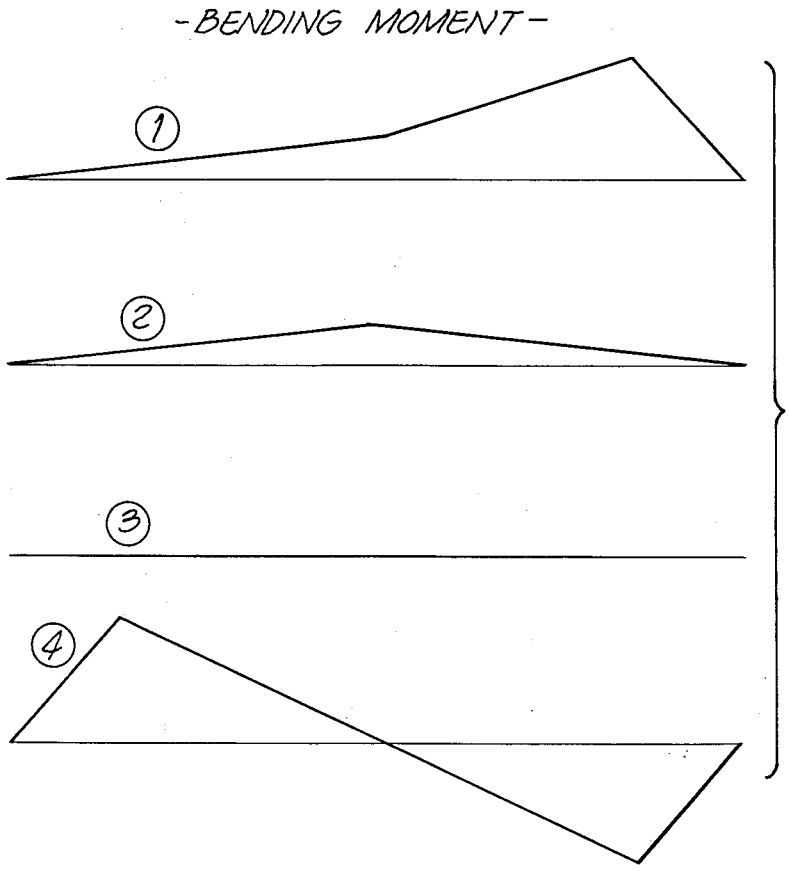
FIG. 5 is a series of curves showing the bending moments on the various arms of the scissors lift shown in the force diagram of FIG. 3.

It will be appreciated from a consideration of the diagrams and equations of FIGS. 3–5 that the structure illustrated in FIG. 1 and the structure illustrated in FIG. 2 are capable of being controlled by the hydraulic cylinder units illustrated in FIGS. 1 and 2 and coupled in the illustrated manner to the linkages.

In the mechanism shown in FIGS. 1 and 2, and described above, the hydraulic units extend essentially in the direction of load, and exert an essentially uniform thrust for all positions of the linkages. This means, as explained above, that the capacity requirements of the hydraulic cylinder units may be minimized, since unlike the prior art mechanisms, there are no excessive load requirements placed on the hydraulic units when the lift mechanism is first elevated from its collapsed position. Also, the positioning of the hydraulic cylinder units adjacent the pivot points of the corresponding arms of the scissors linkages permits the unit to move the scissors lift from its fully retracted to its fully extended position without excessive displacement of the piston in the hydraulic cylinder unit.

In accordance with the above construction, it has been found in connection with the present invention that essentially the entire lift unit may be formed of a mild steel with the exception of the arms in the scissors linkages, and these arms are accordingly made of a high tensile minimum yield steel sheet material. Preferably, the material used in the manufacture of the arms should have a 50,000 psi minimum yield. Nevertheless, the arms can be constructed of a fairly thin gauge material and which are reinforced by the doublers as mentioned above at the points of subject of load.

It has also been found in connection with the present invention that by using the scissors lift linkage construction as described herein the problems of inelastic instability of the arm which serves as a beam and aids in eliminating the typical problem of beam deflection. It can be observed that loads are transmitted from one arm to the other arm at the end pivot points of each of the arms and, moreover, the loads are transmitted through the hydraulic lift units 64 and 66. Consequently, the remaining portions of the beams which form the arms are not subjected to the same tortional or bending moments or forces which thereby permits a much more economical construction of the lift unit.

By utilizing a hydraulic cylinder on every other tier of the scissors linkage, the hydraulic units always extend in essentially vertical position. Moreover, by means of this construction, it is possible to use substantially lower hydraulic pressures for a fixed cylinder and piston area than was attainable in the prior art.

Figure 6:
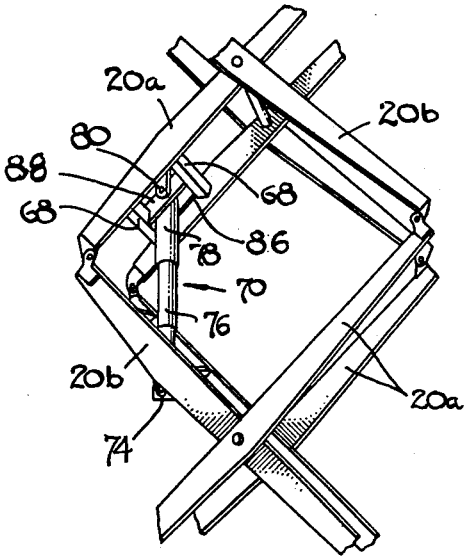
FIG. 6 is a perspective representation of a portion of a scissors lift of the type shown in FIG. 1, and which incorporates upper and lower saddle structures for coupling the hydraulic lift unit to the adjacent arms of the scissors lift.
Figure 7:
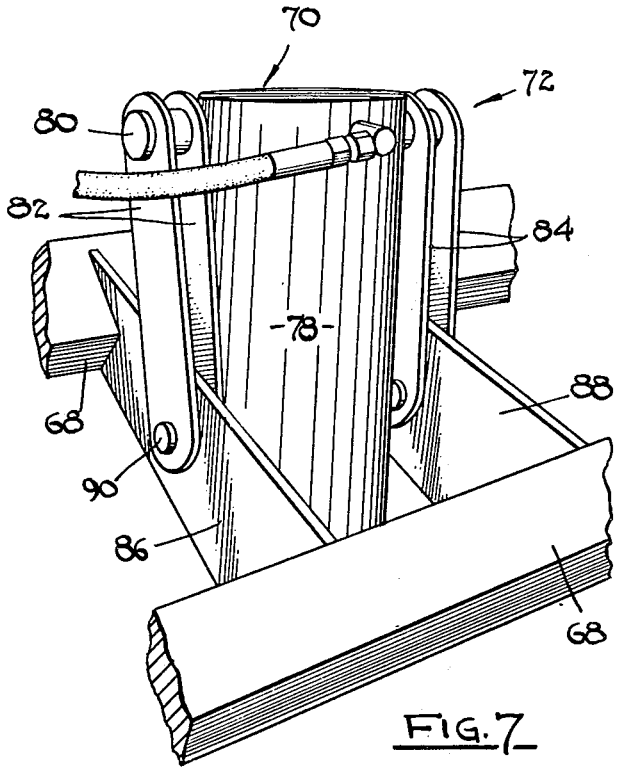
FIG. 7 is another perspective representation of the upper saddle structure.
Figure 8:
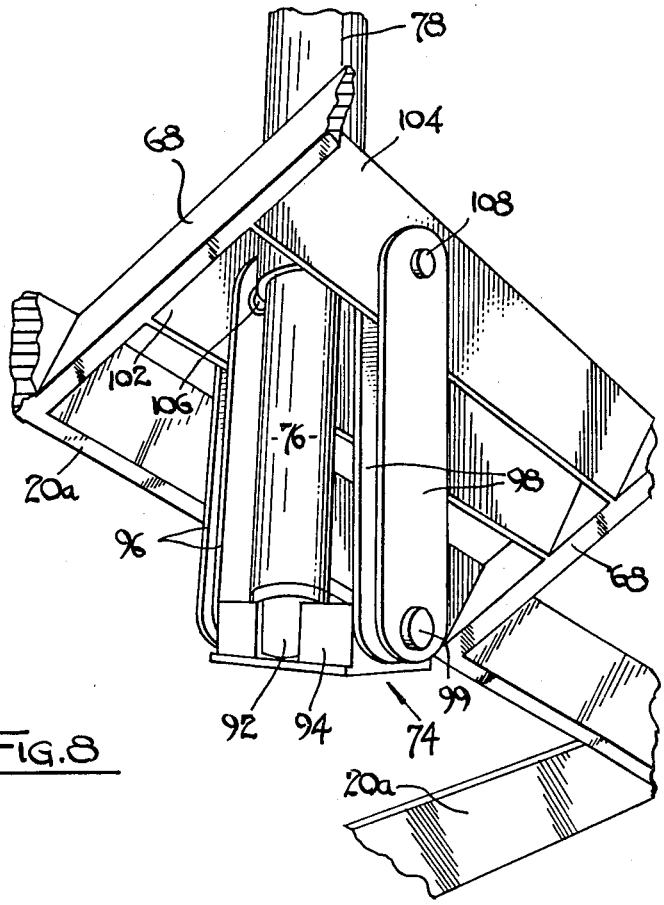
FIG. 8 is a further perspective representation of the lower saddle structure.

The representations of FIGS. 6, 7 and 8 show upper and lower saddle structures for coupling the hydraulic cylinder unit to the adjacent arms 20*a* of the scissors lift mechanism, so as to permit the hydraulic unit to remain in an essentially vertical position as it drives the arms 20*a* coupled to the upper and lower ends of the hydraulic unit angularly about the axis of their hinges.

In the embodiment of FIGS. 6–8, the hydraulic unit 70 is suspended between the cross bars 68 of the respective arms 20*a* and 20*b* by means of upper and lower saddle structures 72 and 74, respectively. In the illustrated embodiment, the hydraulic unit 70 has two telescoping pistons 76 and a cylinder 78, with the unit 70 being mounted so that the cylinder 78 is at the upper end of the unit, pivotally secured to the upper saddle structure 72. Thus, the pistons 76 extend downwardly and are pivotally secured to the lower saddle structure 74. As shown in FIG. 7, the upper end of the cylinder 78 of the hydraulic unit 70 has a transverse pin 80 extending through it which pivotally mounts the upper ends of two pairs of linkages 82 and 84 on either side of the cylinder 78. The other ends of the linkages 82 and 84 are pivotally coupled to respective brackets 86 and 88 which extend between the adjacent cross bars 68, this being achieved by means of pins, such as the pin 90. These elements such as the linkages 82 and 84 and the pivot means, e.g. the transverse pin 80 constitute the upper saddle structure 72, although the brackets 86 and 88 along with the pivot, e.g. the pin 90, could be considered to constitute part of the upper saddle structure 72.

By further reference to FIG. 7, it can be observed that each linkage in a pair of such linkages is similarly sized to and retained in spaced apart parallel relation to the other linkage of such pair. Moreover, it can also be observed that the brackets 86 and 88 are generally perpendicular to the cross bars 68 and generally parallel in space to the respective arms 20*a* and 20*b* with which they are associated.

The lower end of the piston 76 of the hydraulic unit 70 is secured to the saddle structure 74 in the manner as illustrated in FIG. 8. The lower end of the piston 76 is provided with an extended flange 92. The lower saddle structure 74 has a transverse member 94 attached to the flange 92, and this transverse member 94 is pivotally coupled to the lower ends of adjacent pairs of linkages 96 and 98 by means of a pin 99. It should be understood that the flange 92 and the transverse member 94 are provided with aligned apertures (not shown) which accommodate the pin 99, and in this way the piston 76 is attached to the transverse member 94. The upper ends of the linkages 96 and 98 are respectively coupled to brackets 102 and 104 by pins 106 and 108, respectively, and the brackets 102 and 104 are secured to the opposed cross-bars 68. These latter elements such as the linkages 96 and 98 and the pivot means, e.g. the pin 90, constitute the lower saddle structure 74, although the brackets 102 and 104 along with the pivots, e.g. the pins 106 and 108, could be considered part of the lower saddle structure 74.

By further reference to FIG. 8, it can also be observed that each linkage in a pair of the linkages 96 and 98 is similarly sized to and retained in spaced apart parallel relation to the other linkage of such pair. In like manner, the brackets 102 and 104 are generally perpendicular to the cross bars 68 and are generally parallel in space to the arms 20*a* and 20*b*. The linkage arms 20*a* are also illustrated in FIG. 8 in order to show the perpendicular relationship between the cross bars 21 and the parallel relationship to the arms 20*a*.

The upper and lower saddle structures described above serve to maintain the hydraulic cylinder unit 70 in an essentially vertical position, as it moves the upper and lower adjacent arms 20*a* and 20*b* angularly to raise and lower the scissors lift mechanism. These saddle structures permit the lift to be completely retracted so that the adjacent arms 20*a* or 20*b* lie across one another when the platform is in its lowermost position, and then to be fully extended, with the hydraulic unit 70 being maintained in its vertical position at all times, so as to exert maximum force on the adjacent arms.

The resulting mechanism constructed in accordance with the invention is relatively simple and economical in its construction, and yet it is capable of performing all the functions of the equivalent complex prior art mechanisms at all load levels, and on a simpler, more economical and safer basis.

With respect to the saddle structures described above, it can be observed that the linkages 82 and 84 are formed of steel straps and generally should have fairly close alignment. Otherwise, if the straps were not aligned, a cocking of the cylinder and a bending of the straps would result. Consequently, one set of arms would receive the load and upset the entire balance of the various two adjacent pairs of linkages. In this same respect, it can be observed that the loads are transferred from one arm in a linkage to another arm in another linkage with fairly uniform load transfer occurring both through the hydraulic lift mechanisms and through the ear-shaped brackets at the ends thereof.

The transverse member 94 which functions as a saddle block actually performs three major functions. The first of these functions is to maintain loading of the associated cylinder and not permitting the cylinders to slide from one side to the other in a transverse direction. In addition, this saddle block 94 maintains centering of the pin 99. Moreover, and more importantly, the saddle block 94 holds the pin 99 in a sheared condition rather than a bending moment condition.

Figure 9:
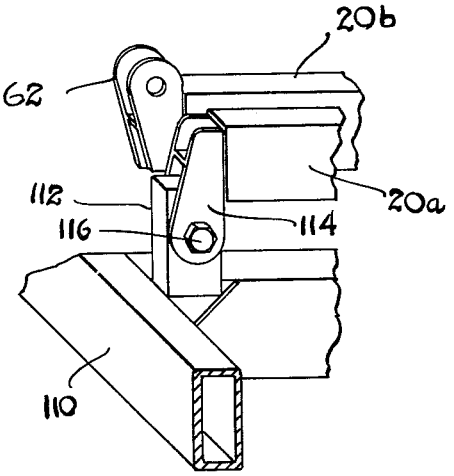
FIG. 9 is a partial perspective view of an end connection of adjacent arms of the scissors lift.
Figure 10:
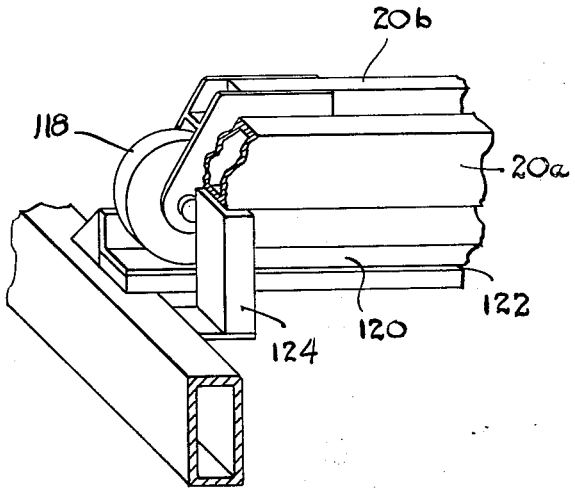
FIG. 10 is a partial perspective view showing the end connections of adjacent arms of the scissors lift at the opposite ends thereof with respect to FIG. 9.

FIGS. 9 and 10 illustrate an alternate embodiment of mounting the lowermost arms of the lowermost tiers of scissors linkages to the frame. In this case, reference numeral 110 designates the base frame. An upstanding pivot block 112 is welded or otherwise secured to the upper surface of the frame 110. Pivotally secured to the pivot block 112 is an ear 114 corresponding to an ear 58 which is pivotally secured to the pivot block 112 by means of a pivot pin 116. This ear is welded or otherwise rigidly secured to one of the arms 20*a*. The next adjacent arm forming part of the scissors linkage, namely the arm 20*b*, which is pivoted to the last mentioned arm 20*a* at a centerpoint, is also pivoted at the same corresponding end at the pivot block 112 through the ears 58 and 62 to another arm 20*a* (not shown). In this case, it can be observed that the innermost arms 20*a* and 20*b* are spaced upwardly from the frame 110 when in the nested condition.

By referring to FIG. 10, it can be observed that the opposite end of the last mentioned arm 20*b* is provided with a roller 118 which rides within a trackway 120 essentially formed by an L-shaped beam 122. Again, the outermost first mentioned arm 20*a* is pivoted to another arm 20*b* (not shown) and is supported on an upstanding support post 124.

Figure 13:
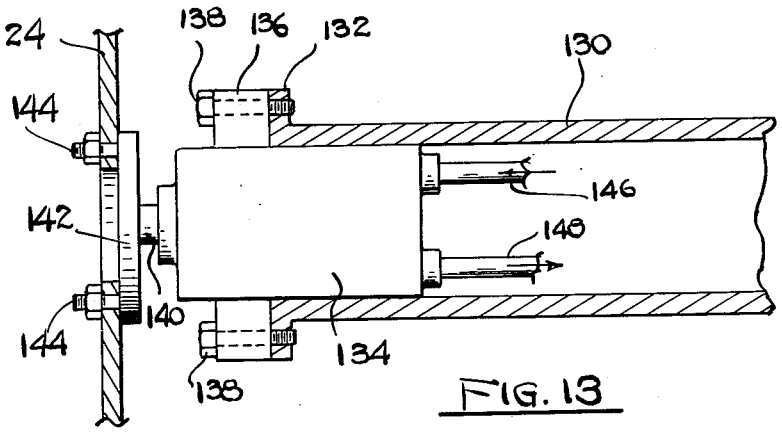
FIG. 13 is a vertical sectional view showing one of the drive mechanisms for the wheels used in the lift of the present invention.

FIG. 13 illustrates a modified form of construction for driving the various wheels 24. In this case, a hollow tubular shaft 130 extends between opposed wheels on opposite transverse sides of the base frame 22. The tubular shaft 130 is provided with an annular outwardly struck peripheral flange 132 at each transverse end thereof. Inserted within the open end of the shaft 130 at each of the ends is a hydraulic motor 134 which is constructed with an annular hub 136 which abuts against the flanges 132. In this case, the hub 136 could be bolted to the flange 132 by means of bolts 138.

The motor 134 is provided with a drive shaft 140 which serves as an axle and is provided with a mounting plate 142. In this case, the mounting plate 142 is bolted or otherwise secured to the wheel 24 through studs 144. Moreover, it can be observed that the hydraulic motor 134 is supplied with a hydraulic driving fluid through inlet and outlet tubes 146 and 148, respectively. In this respect, the inlet and outlet tubes 146 and 148 would be connected to a suitable source of hydraulic fluid under pressure including a reservoir and a pump.

Thus, there has been illustrated and described a unique and novel lift unit which can be made in a variety of sizes and shapes, and used in a wide variety of applications, and which therefore fulfills all of the objects and advantages sought therefor. Many changes, modifications, variations and other uses and applications of the subject lift unit and the components thereof will become apparent to those skilled in the art after considering this specification and the accompanying drawings. All such changes, modifications, variations and other uses and applications which do not depart from the spirit and scope of the invention are deemed to be covered by the invention which is limited only by the following claims.

What I desire to claim and secure by letters patent is:

1. A load lifting scissors lift assembly comprising: a base frame, an upper platform, first and second pairs of crossed lever arms forming a pair of vertically-extensible parallel scissor-type linkages interposed between said base frame and said upper platform, said lever arms of said linkages being operatively coupled to said base frame and said platform to enable vertical shiftable movement of said platform relative to said base frame, an extensible drive unit, a first pair of transverse members extending between each arm of said first pair of lever arms and a second pair of transverse members extending between each arm of said second pair of lever arms, a first saddle structure pivotally connected to one end of said drive unit and also being operatively pivotally connected to said first transverse members, and a second saddle structure pivotally connected to the other end of said drive unit and also being operatively pivotally connected to the second of said transverse members, said first and second saddle structures being located relative to said first and second pairs of crossed lever arms to enable said drive unit to remain in substantially the same position in space relative to movement of said lever arms during their vertically extensible movement.

2. The load lifting scissors lift assembly defined in claim 1 and in which said extensible drive unit is an essentially vertically positioned extensible drive unit.

3. The load lifting scissors lift assembly defined in claim 2 in which said extensible drive unit comprises a hydraulic piston/cylinder unit.

4. The load lifting scissors lift assembly defined in claim 1 in which said extensible drive unit comprises a hydraulic cylinder unit having a cylinder and a piston, and wherein the cylinder is connected to the first saddle structure and the piston is connected to the second saddle structure.

5. The load lifting scissors lift assembly defined in claim 1, in which said first pair of transverse members are connected to points on each one of said first pairs of arms between the centers and one of the ends thereof, and in which the second transverse members are connected to points on each one of the second pairs of arms between the centers and one of the ends thereof.

6. The load lifting scissors lift assembly defined in claim 1 further characterized in that a plurality of drive wheels are rotatably mounted on said base frame, and a separate powered means drives each of said drive wheels.

7. The load lifting scissors lift assembly defined in claim 6 further characterized in that at least two of said drive wheels are connected to a transverse tubular member, and said powered means are mounted at each of the opposite transverse ends of said tubular member, and each said powered means includes a drive shaft which is connected directly to an associated drive wheel.

8. A load lifting scissors lift assembly as deinfed in claim 1 further characterized in that the first and second pairs of transverse members are substantially vertically movable as the lift mechanism raises and lowers the upper platform.

9. The load lifting scissors lift assembly defined in claim 1 in which a first pair of spaced and parallel longitudinal brackets extend between the first pair of transverse members, and a second pair of spaced and parallel longitudinal brackets extend between the second pair of transverse members, and said saddle structures are operatively pivotally connected to said first and second pairs of brackets.

10. The load lifting scissors lift assembly defined in claim 9, and wherein said first saddle structure comprises a plurality of first linkage arms, each of said linkage arms having one end pivotally coupled to one end of said hydraulic unit and each of said first linkage arms having their other ends pivotally coupled to the longitudinal brackets of the first pair.

11. The load lifting scissors lift assembly defined in claim 10 and wherein said second saddle structure comprises a plurality of second linkage arms, each of said second linkage arms having one end pivotally coupled to another end of said hydraulic unit, and each of said second linkage arms having their other ends pivotally coupled to the longitudinal brackets of said second pair.

12. A load lifting scissors lift assembly comprising: a base frame, an upper platform, first and second pairs of crossed lever arms forming a pair of vertically-extensible, parallel scissor-type linkages interposed between said base frame and said upper platform, said lever arms of said linkages being operatively coupled to said base frame and said platform to enable vertical shiftable movement of said platform relative to said base frame, an extensible drive unit, a first pair of transverse members extending between each arm of said first pair of lever arms and a second pair of transverse members extending between each arm of said second pair of lever arms, a first saddle structure pivotally connected to said drive unit and also being operatively pivotally connected to said first transverse members and a second saddle structure pivotally connected to said drive unit at a point on said drive unit spaced apart with respect to the connection of said first saddle structure and drive unit, and said second saddle structure also being operatively pivotally connected to the second of said transverse members, said first and second saddle structures being located relative to said first and second pairs of crossed lever arms to enable said drive unit to remain in substantially the same position in spaced relative to movement of said lever arms during their vertically extensible movement.

13. The load lifting scissors lift assembly defined in claim 12 and in which said extensible drive unit is an essentially vertically positioned extensible drive unit.

14. The load lifting scissors lift assembly defined in claim 12 in which said first pair of transverse members are connected to points on each one of said first pairs of arms between the centers and one of the ends thereof, and in which the second transverse members are connected to points on each one of the second pairs of arms between the centers and one of the ends thereof.

15. The load lifting scissors lift assembly defined in claim 12 in which a first pair of spaced and parallel longitudinal brackets extend between the first pair of transverse members and a second pair of spaced and parallel longitudinal brackets extend between the second pair of transverse members, and said saddle structures are operatively pivotally connected to said first and second pairs of brackets.

16. The load lifting scissors lift assembly defined in claim 15 and wherein said first saddle structure comprises a plurality of first linkage arms, each of said linkage arms having one end pivotally coupled to one end of said hydraulic unit and each of said first linkage arms having their other ends pivotally coupled to the longitudinal brackets of the first pair.

17. The load lifting scissors lift assembly defined in claim 16 and wherein said second saddle structure comprises a plurality of second linkage arms, each of said second linkage arms having one end pivotally coupled to another end of said hydraulic unit, and each of said second linkage arms having their other ends pivotally coupled to the longitudinal brackets of said second pair.

18. A load lifting scissors lift assembly comprising: a lower frame, an upper platform, a plurality of tiers of crossed lever arms with each of said tiers comprised of first and second pairs of cross lever arms forming a pair of vertically- (laterally spaced) extensible parallel scissors-type linkages interposed between said lower frame and said upper platform, the lever arms of each of said linkages being pivotally coupled to one another at the ends thereof and at a single point intermediate said ends, a first upstanding retaining member on said lower frame in proximity to one end thereof, ear means pivotally connecting one end of one of the lever arms of the first pair of the lowermost tier at the end thereof to said upstanding retaining member in such manner that the axis of the pivotal connection is displaced away from the longitudinal axis of said last-named lever arm, track means on said lower frame, and roller means movable in said track means rotatably supporting one end of one of the lever arms of the second pair of the lowermost tier, and which last-named arms of the first and second pairs of arms being located on the same lateral side of said lower frame, an upstanding support post on said lower frame in proximity to the other end thereof and having a height to support the lever arm connected to said upstanding retaining member in a flat relatively horizontal position when said lever arms are shifted to the collapsed position, an essentially vertically positioned extensible drive unit, and connecting means for connecting said drive unit to said first pair of arms and to said second pair of arms, said connecting means including at least one first transverse member operatively connected to said drive unit and to said first arms at a point intermediate the ends thereof, and at least one second transverse member operatively connected to said drive unit and to said second arm at a point intermediate the ends thereof, the first and second transverse members being essentially vertically movable in opposite directions as the left assembly raises and lowers the upper platform and the drive unit remains in substantially the same vertical position in space relative to the movement of said lever arms during their vertically extensible movement.

19. The load lifting scissors lift assembly of claim 18 further characterized in that said first transverse means comprises at least one first transverse member, said first saddle means pivotally connects said first transverse member to said drive unit, said second transverse means comprises at least one second transverse member, and second saddle means pivotally connects said second transverse member to said drive unit, the first and second saddle means being arranged so that the first and second transverse members are essentially vertically movable.

20. A load lifting scissors lift assembly comprising: a base frame, an upper platform, first and second pairs of crossed lever arms forming a pair of vertically-extensible parallel scissor-type linkages interposed between said base frame and said upper platform, said lever arms of said linkages being operatively coupled to said base frame and said platform to enable vertical shiftable movement of said platform relative to said base frame, an extensible drive unit, means for operatively coupling said drive unit to said first and second pairs of crossed lever arms, said means for operatively coupling comprising at least one transverse means extending between each arm of said first pair of lever arms and at least one second transverse means extending between each arm of said second pair of lever arms, a first connecting means comprising a first saddle structure pivotally connected to one end of said drive unit and also being operatively pivotally connected to said first transverse means, and a second connecting means pivotally connected to the other end of said drive unit and also being operatively pivotally connected to the second of said transverse means, said first and second connecting means being located relative to said first and second pairs of crossed lever arms to enable said drive unit to remain in substantially the same position in space relative to movement of said lever arms during their vertically extensible movement.

21. The load lifting scissors lift assembly defined in claim 20 and in which said extensible drive unit is a substantially vertically positioned extensible hydraulic piston/cylinder drive unit.

22. The load lifting scissors lift assembly defined in claim 20 in which said first transverse means comprises a pair of spaced apart first transverse members, a first pair of spaced and parallel longitudinal brackets are connected to the first transverse means, and said first connecting means is operatively pivotally connected respectively to said first pair of brackets.

23. The load lifting scissors lift assembly defined in claim 22 and wherein said first saddle structure comprises a plurality of first linkage arms, each of said linkage arms having one end pivotally coupled to one end of said drive unit and each of said first linkage arms having their other ends pivotally coupled to the first pair of longitudinal brackets.

24. A load lifting scissors lift assembly comprising: a base frame, an upper platform, first and second pairs of crossed lever arms forming a pair of vertically-extensible, parallel scissor-type linkages interposed between said base frame and said upper platform, said lever arms of said linkages being operatively coupled to said base frame and said platform to enable vertical shiftable movement of said platform relative to said base frame, an extensible drive unit, means for operatively coupling said drive unit to said first and second pairs of said crossed lever arms, said means for operating coupling comprising at least a first transverse means extending between each arm of said first pair of lever arms and a second transverse means extending between each arm of said second pair of lever arms, a first saddle structure pivotally connected to said drive unit and also being operatively pivotally connected to said first transverse means and a second saddle structure pivotally connected to said drive unit at a point on said drive unit spaced apart with respect to the connection of said first saddle structure and drive unit, and said second saddle structure also being operatively pivotally connected to the second of said transverse means, said first and second saddle structures being located relative to said first and second pairs of crossed lever arms to enable said drive unit to remain in substantially the same position in space relative to movement of said lever arms during their vertically extensible movement.

25. The load lifting scissors lift assembly defined in claim 24 and in which said extensible drive unit is a substantially vertically positioned extensible drive unit.

26. The load lifting scissors lift assembly defined in claim 24 in which said first transverse means comprises at least one first transverse member and said second transverse means comprises at least one second transverse member, a first pair of spaced and parallel longitudinal brackets are connected to the first transverse member and a second pair of spaced and parallel longitudinal brackets are connected to the second transverse member, and said saddle structures are operatively pivotally connected to said first and second pairs of brackets.

27. The load lifting scissors lift assembly defined in claim 26 and wherein said first saddle structure comprises a plurality of first linkage arms, each of said linkage arms having one end pivotally coupled to one end of said drive unit and each of said first linkage arms having their other ends pivotally coupled to the longitudinal brackets of the first pair.

28. The load lifting scissors lift assembly defined in claim 27 and wherein said second saddle structure comprises a plurality of second linkage arms, each of said second linkage arms having one end pivotally coupled to another end of said drive unit, and each of said second linkage arms having their other ends pivotally coupled to the longitudinal brackets of said second pair.

29. A load lifting scissors lift assembly comprising: a base frame, an upper platform, first and second pairs of crossed lever arms forming a pair of vertically-extensible parallel scissor-type linkages interposed between said base frame and said upper platform, said lever arms of said linkages being operatively coupled to said base frame and said platform to enable vertical shiftable movement of said platform relative to said base frame, an extensible drive unit, a first pair of transverse members extending between and connected to points on each one of the first pair of arms between the centers and one of the ends thereof, and a second pair of transverse members extending between and connected to points on each one of the second pair of lever arms between the centers and one of the ends thereof, a first connecting means comprising a first saddle structure pivotally connected to one end of said drive unit and also being operatively pivotally connected to said first pair of transverse members, and a second connecting means pivotally connected to the other end of said drive unit and also being operatively pivotally connected to the second pair of said transverse members, said first and second connecting means being located relative to said first and second pairs of crossed lever arms to enable said drive unit to remain in substantially the same position in space relative to movement of said lever arms during their vertically extensible movement.

30. The load lifting scissors lift assembly defined in claim 29 and in which said extensible drive unit is a substantially vertically positioned extensible hydraulic piston/cylinder drive unit.

31. The load lifting scissors lift assembly defined in claim 29 in which a first pair of spaced and parallel longitudinal brackets extend between the first pair of transverse members, and said first connecting means is respectively operatively pivotally connected to said first pair of brackets.

32. The load lifting scissors lift assembly defined in claim 31 and wherein said first saddle structure comprises a plurality of first linkage arms, each of said first linkage arms having one end pivotally coupled to one end of said drive unit, and each of said first linkage arms having their other ends pivotally coupled to the longitudinal brackets of said first pair.

33. A load lifting scissors lift assembly comprising: a base frame, an upper platform, a plurality of pairs of crossed lever arms forming a plurality of vertically-extensible parallel scissor-type linkages interposed between said base frame and said upper platform, said lever arms of said linkages being operatively coupled to said base frame and said platform to enable vertical shiftable movement of said platform relative to said base frame, an extensible drive unit, means for operatively coupling said drive unit to a first of said pairs of crossed lever arms and another of said pairs of crossed lever arms, said means for operatively coupling comprising a first transverse means extending between each arm of said first pair of lever arms and a second transverse means extending between each arm of said another pair of lever arms, a first connecting means comprising a first saddle structure pivotally connected to one end of said drive unit and also being operatively pivotally connected to said first transverse means, and a second connecting means pivotally connected to the other end of said drive unit and also being operatively pivotally connected to the second transverse means, said first and second connecting means being located relative to said first pair of crossed lever arms and said another pair of crossed lever arms to enable said drive unit to cause vertically extensible movement of said scissor-type linkage.

34. The load lifting scissors lift assembly defined in claim 33 and in which said extensible drive unit is a substantially vertically positioned extensible hydraulic piston/cylinder drive unit.

35. The load lifting scissors lift assembly defined in claim 33 in which said drive unit remains in substantially the same position in space relative to movement of said lever arms during their vertically extensible movement.

36. The load lifting scissors lift assembly defined in claim 33 in which said first transverse means comprises at least one first transverse member, a first pair of spaced and parallel longitudinal brackets are connected to the first transverse member, and said first connecting means is operatively pivotally connected respectively to said first pair of brackets.

37. The load lifting scissors lift assembly defined in claim 36 and wherein said first saddle means comprises a plurality of fist linkage arms, each of said linkage arms having one end pivotally coupled to one end of said drive unit and each of said first linkage arms having their other ends pivotally coupled to the longitudinal brackets of the first pair.

38. A load lifting scissors lift assembly comprising: a base frame, an upper platform, first and second pairs of crossed lever arms forming a pair of vertically-extensible, parallel scissor-type linkages interposed between said base frame and said upper platform, said lever arms of said linkages being operatively coupled to said base frame and said platform to enable vertical shiftable movement of said platform relative to said base frame, an extensible drive unit, a first transverse means extending between each arm of said first pair of lever arms and a second transverse means extending between each arm of said second pair of lever arms, at least one first longitudinal bracket connected to said first transverse means, a first connecting means comprising a first linkage arm and being pivotally connected at one end to said first longitudinal bracket, pivot means pivotally connecting the other end of said first linkage arm to said drive unit, and a second connecting means pivotally connected to said drive unit at a point on said drive unit spaced apart with respect to the connection of said pivot means and drive unit, and said second connecting means also being operatively pivotally connected to the second of said transverse means, said first and second connecting means being located relative to said first and second pairs of crossed lever arms to enable said drive unit to cause vertically extensible movement of said scissor-type linkages.

39. The load lifting scissors lift assembly defined in claim 38 and in which said extensible drive unit is a substantially vertically positioned extensible drive unit.

40. The load lifting scissors lift assembly defined in claim 38 and in which said drive unit remains in substantially the same position in space relative to movement of said lever arms during their vertically extensible movement.

41. The load lifting scissors lift assembly defined in claim 38 and in which said first connecting means comprises a second linkage arm pivotally connected at one end to said first longitudinal bracket and at its other end to said drive unit by said pivot means.

42. The load lifting scissors lift assembly defined in claim 41 and in which said first transverse means comprises a pair of spaced apart first transverse members, a second longitudinal bracket is connected to said first pair of transverse members said first linkage arm being pivotally connected to said first longitudinal bracket and said second linkage arm being pivotally connected to said second longitudinal bracket.

43. The load lifting scissors lift assembly defined in claim 38 in which a first pair of spaced transverse members extend between each arm of said first pair of lever arms and parallel longitudinal brackets extend between and are connected to the first pair of transverse members, a pair of first linkage arms, each of said linkage arms having one end pivotally coupled to one end of said drive unit and each of said first linkage arms having their other ends pivotally coupled to each one of the longitudinal brackets of the first pair of longitudinal brackets.

* * * * *